US011371192B2

(12) United States Patent
Novick et al.

(10) Patent No.: US 11,371,192 B2
(45) Date of Patent: Jun. 28, 2022

(54) PAVER FOR POROUS PAVEMENT

(71) Applicant: Porous Technologies, LLC, South Portland, ME (US)

(72) Inventors: Gregg Novick, Greenwood, ME (US); Gary Verrill, Gorham, ME (US)

( * ) Notice: Subject to any disclaimer, the term of this patent is extended or adjusted under 35 U.S.C. 154(b) by 0 days.

(21) Appl. No.: 15/956,519

(22) Filed: Apr. 18, 2018

(65) Prior Publication Data

US 2018/0237997 A1 Aug. 23, 2018

Related U.S. Application Data

(63) Continuation of application No. 13/062,577, filed as application No. PCT/US2010/037399 on Jun. 4, 2010.

(60) Provisional application No. 61/249,068, filed on Oct. 6, 2009, provisional application No. 61/184,034, filed on Jun. 4, 2009.

(51) Int. Cl.
*E01C 11/22* (2006.01)

(52) U.S. Cl.
CPC ..... *E01C 11/225* (2013.01)

(58) Field of Classification Search
CPC ..... E01C 11/225
USPC ..... 404/34, 29; 52/596; 405/16, 20
See application file for complete search history.

(56) References Cited

U.S. PATENT DOCUMENTS 2,315,732 A 4/1943 Patch
3,590,538 A * 7/1971 Holt ..... E04B 1/4121 52/127.3
4,000,591 A * 1/1977 Courtois ..... B28B 23/005 52/125.4
4,179,151 A * 12/1979 Tye ..... E04G 21/142 294/89
5,242,249 A 9/1993 Grayson
5,281,048 A 1/1994 Hagenah
6,293,065 B1 9/2001 Suzuki et al.
6,688,808 B2 2/2004 Lee
7,425,106 B2 9/2008 Altmann et al.
8,875,471 B2 * 11/2014 Siqueiros ..... E01C 23/10 52/125.5
2001/0019684 A1 9/2001 Manthei et al.
2006/0032807 A1 2/2006 Sansalone
2006/0034652 A1 2/2006 Sanders
2006/0159517 A1 7/2006 Hagerman et al.
(Continued)

FOREIGN PATENT DOCUMENTS

EP 0610612 A1 8/1994
KR 1020080073633 B1 8/2008
KR 1008924190000 B1 4/2009

OTHER PUBLICATIONS

Best available translation of item KR1008924190000, Apr. 1, 2009, to Kim, Dong Hyun, 8 pp. (Obtained from WIPO).
(Continued)

*Primary Examiner* — Abigail A Risic
(74) *Attorney, Agent, or Firm* — Tredecim LLC; Sean L. Sweeney

(57) ABSTRACT

A porous pavement system and a method of maintaining the porous pavement system are disclosed. A combination of porous and non-porous pavers are laid out to create a porous pavement. A receptacle or retainer for receiving a tool is in incorporated into the porous pavers, to facilitate lifting the pavers by means of the tool. A cradle may be used to hold multiple pavers.

9 Claims, 3 Drawing Sheets

(56) References Cited

U.S. PATENT DOCUMENTS

| | | | | |
|---|---|---|---|---|
| 2007/0269265 | A1 | 11/2007 | Thorkelson | |
| 2008/0279626 | A1 | 11/2008 | Altmann et al. | |
| 2009/0180833 | A1 | 7/2009 | Buch | |
| 2009/0238646 | A1* | 9/2009 | Sansalone ..... | B01D 15/00 405/45 |
| 2010/0047016 | A1 | 2/2010 | Wu | |
| 2011/0064517 | A1 | 3/2011 | Sader | |
| 2011/0193267 | A1 | 8/2011 | Tonder et al. | |

OTHER PUBLICATIONS

Best available translation of item KR1020080073633, Aug. 11, 2008, to Kim, Do Hwan, 7 pp. (Obtained from WIPO).
Cast Stone Institute, Standard Specification 04 72 00-04, Revised 2004, pp. 4.
American Concrete Institute Commitee 522, ACI 522R-06 Pervious Concrete, 2006, pp. 25.

* cited by examiner

PAVER FOR POROUS PAVEMENT

CROSS-REFERENCE TO RELATED APPLICATIONS

This application is a continuation of application Ser. No. 13/062,577, which is the National Stage of International Application No. PCT/US2010/037399, filed Jun. 4, 2010, which claims the benefit of U.S. Provisional Application No. 61/184,034, filed on Jun. 4, 2009, and U.S. Provisional Application No. 61/249,068, filed on Oct. 6, 2009, the disclosures of which is herein incorporated by reference.

BACKGROUND

1. Field of the Invention

The invention relates to a porous paver. More particularly, the invention relates to a porous paver and a method of providing a porous pavement.

2. Discussion of Background Information

It is known to use porous pavement to provide pavement that allows stormwater to infiltrate back into the ground naturally, rather than to run off. The porous pavement made with pavers typically includes a method of laying out non-porous pavers to provide a load-bearing pavement surface, with regularly dispersed void areas between the pavers. The non-porous pavers are typically concrete blocks, bricks, or reinforced plastic mats. The void areas are then filled with gravel, sand, or grass turf, which allow the stormwater to infiltrate into the ground.

Porous pavers or pavement serve their function only if the water can actually pass through the paver or pavement at a minimum specified rate. Porous pavement is known. With time, however, the porosity is substantially diminished, because the porous material becomes clogged with sediment, debris, or other materials that prevent the stormwater from flowing through the pavement. The construction of porous pavement also requires attention to certain temperature parameters. For example, if the porous pavement is laid down and then subjected to freeze-thaw cycles before it is cured, the pavement will crack and crumble. The remedy for clogged or cracked porous pavement is to dig it up and replace it, a costly undertaking.

What is needed, therefore, is a porous paving system that is readily cleanable, maintainable, or replaceable. What is further needed is such a system, the components of which can be manufactured under controlled conditions.

SUMMARY OF THE INVENTION

The invention is a porous pavement system that is based on a paver made of porous material, whereby a retrieval means is provided in the porous paver, so as to allow individual porous pavers to be removed from the pavement for cleaning, replenishing, or replacement, as needed. The invention also encompasses a paved surface that is made up of a combination of porous and non-porous pavers, and/or one that uses a hybrid paver.

The hybrid paver is a bi-material paver block that provides the desired load-bearing properties of conventional non-porous pavers and the desired filtration properties of porous pavement for allowing passage of stormwater through the pavement into the ground. The hybrid paver according to the invention comprises an outer portion that is non-porous and an inner portion that is porous. In other words, the hybrid paver has a donut-like non-porous outer portion and a donut-hole-like porous inner portion. The outer portion includes the entire perimeter of the hybrid paver, i.e., is a structural wall around the porous inner portion, the structural wall having the necessary strength characteristics to provide the desired load-bearing strength of the pavement.

The inner portion is constructed of a porous concrete that provides a specified filtration rate of water, typically stormwater. Additives may be mixed with the porous concrete to filter out specific pollutants. It may be desirable to be able to remove the inner portion from the outer portion for cleaning or replacement. For this reason, the hybrid paver may be constructed as a modular unit from which the inner portion may be readily removed or inserted. In this case, the inner portion is constructed as a cartridge or a modular piece that fits into a cavity in the outer portion. A means for inserting and retrieving the cartridge may be incorporated into the cartridge.

The inner portion and outer portion are made according to conventional industry standards, such as, for example, ASTM standards, if the paver is made of concrete. Each portion of the paver provides the desired load-bearing capability. The inner portion may also be used as a stand-alone porous paver, that is, does not have to be inserted into an outer portion, but may instead be inserted into a cavity that is created by a particular layout configuration of other porous and non-porous pavers.

The pavers used in the porous pavement system according to the invention may be any suitable shape and size. Thus, for example, pavers may be constructed as large slabs, as small regularly shaped blocks, or as decoratively shaped elements. Depending on the size and shape of the pavers, the retrieval means may also be adapted to be coupled to a lifting means that is incorporated into a vehicle that is equipped with some type of hoisting or lifting mechanism, to assist in lifting the paver from the pavement surface or, in the case of large slab-like pavers, also to install the paver.

BRIEF DESCRIPTION OF THE DRAWINGS

The present invention is described with reference to the accompanying drawings. In the drawings, like reference numbers indicate identical or functionally similar elements. The drawings are not drawn to scale.

DETAILED DESCRIPTION OF THE INVENTION

The present invention will now be described more fully in detail with reference to the accompanying drawings, in which the preferred embodiments of the invention are shown. This invention should not, however, be construed as limited to the embodiments set forth herein; rather, they are provided so that this disclosure will be complete and will fully convey the scope of the invention to those skilled in the art.

Figure 2:
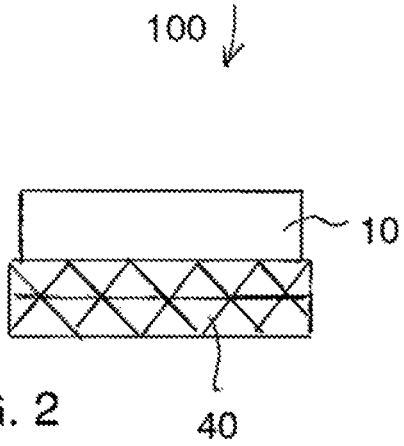
FIG. 2 is a side elevational view of the hybrid paver of FIG. 1. showing a grid-like cradle for a single paver.
Figure 1:
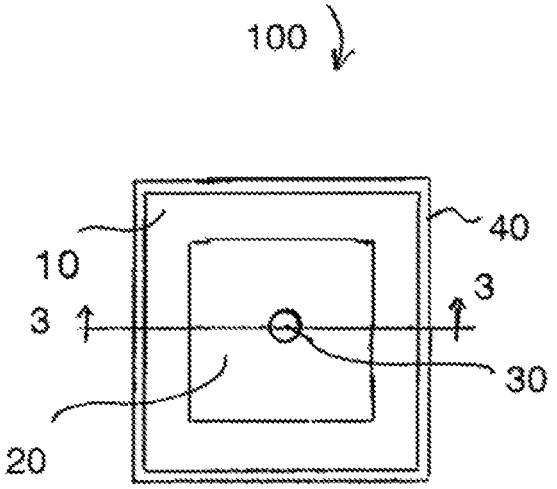
FIG. 1 is a top plane view of the hybrid paver according to the invention.
Figure 5:
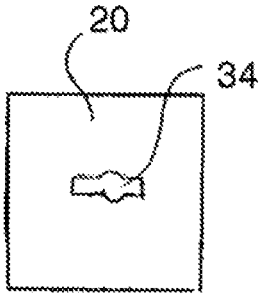
FIG. 5 is a bottom plane view of the porous cartridge.
Figure 4:
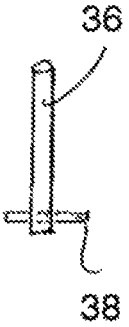
FIG. 4 is an illustration of the retrieval means.

FIGS. 1-5 illustrate the elements of a hybrid paver 100 according to the invention, which comprises a non-porous paver 10, a porous paver 20. The non-porous paver 10 is constructed of a conventional non-porous concrete, which has the desired strength and compression properties for the intended use. As seen in FIG. 1, the non-porous paver 10 has an open center portion that receives the porous cartridge 20. The porous paver 20 is constructed of a porous or pervious concrete or other porous material, according to established industry standards, and allows water, for example, storm-water, to pass through the paver at a given rate. For example, concrete made according to ACI 522.1-08 is a pervious concrete made with aggregates coarse enough to allow water to pass through the concrete to the substrate below and strong enough to be traffic bearing. It is also possible to provide a hybrid paver 100 wherein the non-porous paver 10 has a higher compression strength than that of the porous paver 20, in which case the height dimension of the porous paver 20 may be slightly less than that of the non-porous paver 10. Conventional porous paving material has a height dimension that is greater than that of a non-porous material that provides a corresponding compression strength. Using the hybrid paver 100 according to the invention enables the implementation of a porous paving system in which the height dimension is determined by the strength characteristics of the non-porous paver 10, and thus, the use of a paver that is lower in height than would be expected with conventional porous paving material.

In the embodiment shown in the figures, the porous paver 20 is shown as a porous cartridge that is selectively insertable into and removable from the non-porous paver 10. The porous paver 20, being constructed according to industry standards, may also serve as a paver without the non-porous paver 10.

Figure 3:
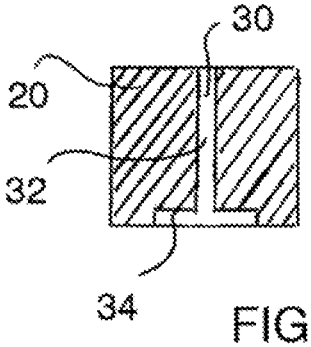
FIG. 3 is a cross-sectional view through the center vertical plane of the porous cartridge.

FIGS. 3-6 illustrate details of a retrieval means 30 that may be used to facilitate insertion and removal of the porous paver 20 into the non-porous paver 10. Porous concrete may become plugged with debris that reduces or blocks the rate of filtration of water through it. The porous cartridge is provided with the retrieval means 30, to facilitate removing the porous cartridge 20 from the non-porous paver 10, for purposes of replacement, replenishing, or cleaning. FIG. 3 is a cross-sectional view along the vertical plane shown in FIG. 1. A through-bore 32 with a cross-groove 34 is provided through the porous paver 20 that is constructed to receive the retrieval means 30, which, in the embodiment shown, includes a bar 38 assembled in a sheath 36. The retrieval means 30 is inserted into the porous paver 20 through the cross-groove 34 in the bottom of the porous paver. A tool T shown in FIG. 6 may be inserted into the porous paver 20 from the top face, such that the hook portion of the tool T engages the bar 38. The porous paver 20 may then be lifted out of the non-porous paver 10.

In the embodiment shown, the retrieval means 30 is illustrated together with the porous paver 20 and the non-porous paver 10. It is understood, however, that the porous paver 20 does not have to be used as a cartridge, but can be used as a stand-alone paver.

In this embodiment, a cradle 40 is provided to hold the non-porous paver 10 and the porous paver 20 together as a single unit. The cradle 40 facilitates handling and placement of the pavers. The cradle 40 may also serve to ensure proper spacing between pavers 100 when they are laid out. In the embodiment shown in FIGS. 1 and 2, the cradle is a shallow rectangular container which is dimensioned to hold the non-porous paver 10 and the porous paver 20. Ideally, the cradle 40 has an open structure, to allow water to pass through it. The cradle 40 may have another construction, for ornamental or functional reasons. For example, the cradle may have a half-high wall that separates the non-porous paver 10 from the porous paver 20 so as to create a space between the two elements, or may be constructed as a bottom flange that extends into the through-bore 32 and connects to or is integrally formed with the retrieval means 30. The cradle 40 thus supports the non-porous paver 10 around the porous paver 20. The material used to construct the cradle 40 is not considered within the scope of the invention. Any suitable material, with the required strength and rigidity properties to support the non-porous paver 10 and the porous paver 20 may be used.

Figure 7:
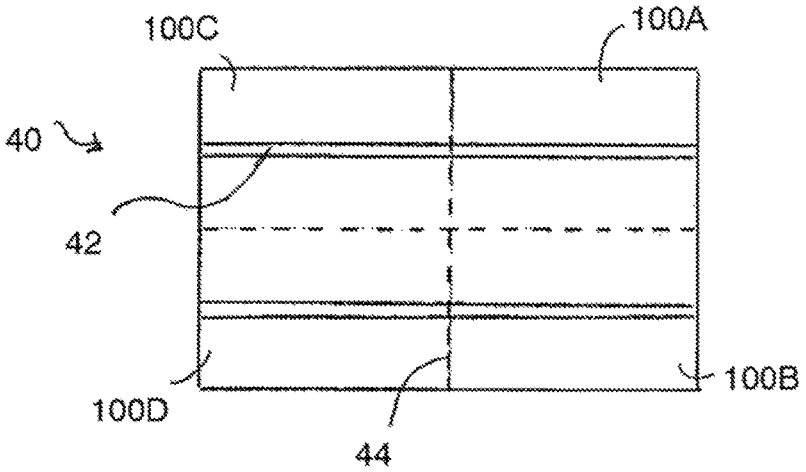
FIG. 7 is a multi-paver cradle, showing keys for locating pavers.

FIG. 7 illustrates another embodiment of the cradle 40, a multi-paver cradle. The cradle 40 has a bottom support and is large enough to receive and support a plurality of pavers. The bottom may be constructed as a grid, as described above, or in some other manner, so as to allow water to pass through it relatively unhindered, and the perimeter may be provided with a lip that hinders a translational motion of the pavers. In the embodiment shown, the cradle 40 is dimensioned to accommodate four hybrid pavers 100, the dashed lines indicating the locations of four hybrid pavers 100A-100D. This is by way of illustration only. It is understood, however, that, depending on the size and shape of the pavers, and the type of equipment used to handle the multi-paver cradle 40, a number of pavers 100 other than 4 may be assembled on the cradle. A guide 42 may be provided on the cradle 40 to aid in holding the hybrid pavers 100 in place. The guide 42 may be a key or ridge; the bottom surfaces of the inner pavers 20 and the outer pavers 10 would then have a corresponding groove or slot. An advantage of the multi-paver cradle 40 is that it greatly enhances the structural stability of a paving system and facilitates handling and installation. The cradle 40 may be handled as a single unit, in which case, four pavers 100 can be moved, handled, or installed as a single unit. The individual pavers 100 are indicated by dashed lines 44. The cradle 40 with the pavers 100A-100D provides much greater stability when installed as a paving system, because the weight of a multi-paver unit provides much greater resistance to tipping. For example, a load applied to a corner of a paver that is individually placed in the paving system may result in the paver tipping. A load applied to a corner of a paver that is assembled on a multi-paver cradle will be much less likely to result in tipping, because of the total weight and the distribution of weight across a much greater area. Also, a shifting of a paver within a paving layout is much less likely, because of the constraint of the cradle. For example, a force applied laterally to one paver is less likely to shift the paver, because it is constrained within the cradle and keyed in position.

In the embodiments described herein, the non-porous paver 10 and the porous paver 20 are constructed of concrete. It is understood, however, that other suitable materials may be used, for the non-porous paver, for the porous paver, for both. Also, the non-porous paver and the porous paver may be made of different materials. Thus, it is possible to make the non-porous paver of brick or a manufactured stone, and the porous paver of pervious or porous concrete, or any suitable porous material, such as recycled glass, tires, asphalt, and combinations of material.

The hybrid paver 100 has been illustrated as a two-component paver. It is considered within the scope of this invention to also provide the paver 100 as a unitary paving block having an outer non-porous paver portion 10 and an inner porous paver portion 20.

The shape of the pavers 100 is irrelevant. A rectangular hybrid paver 100 is shown in the drawings herein, but it is understood that any suitable shape, whether the shape be chosen for ornamental or functional reasons, may be used.

Figure 8:
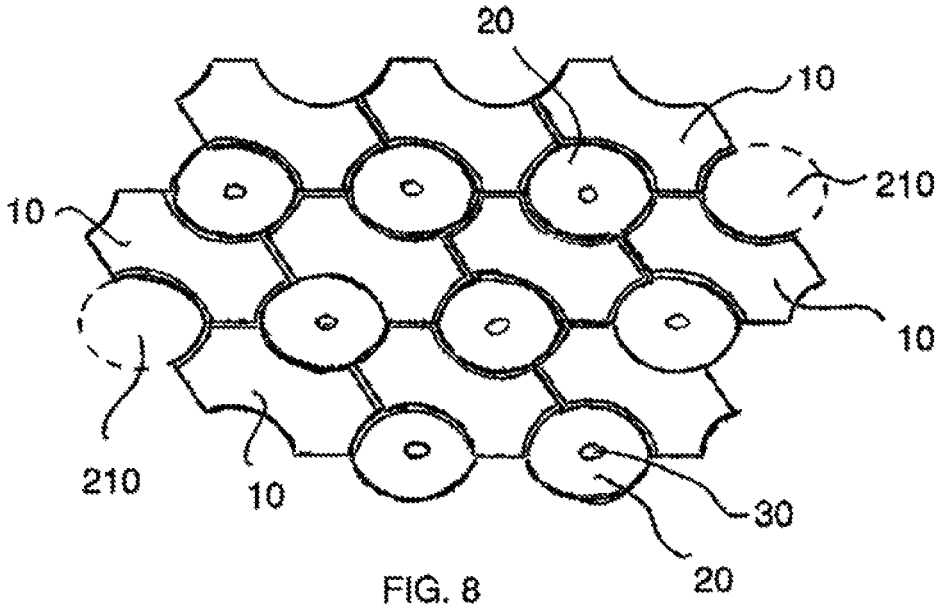
FIG. 8 illustrates a hybrid paved surface formed by an alternating layout of non-porous pavers and porous pavers.

FIG. 8 illustrates a hybrid paved surface 200 according to the invention comprising the non-porous paver 10 and the porous paver 20. The hybrid paved surface 200 is created by laying the pavers 10 and 20 in an alternating pattern. The particular shape of the pavers 10 and 20 shown here is for illustration purposes only. In the embodiment shown, a conventional paver has four recesses formed about its perimeter. Four adjacent pavers together form an approximately circular opening 210. The porous paver 20 is placed in this opening 210. The porous paver 20 includes the retrieval means 30 described above. The particular shape of the pavers 10 is not relevant to the invention. For example, rectangular or square pavers 10 may be laid out in a configuration that creates an space 210 into which the porous paver 20 is inserted.

Figure 10:
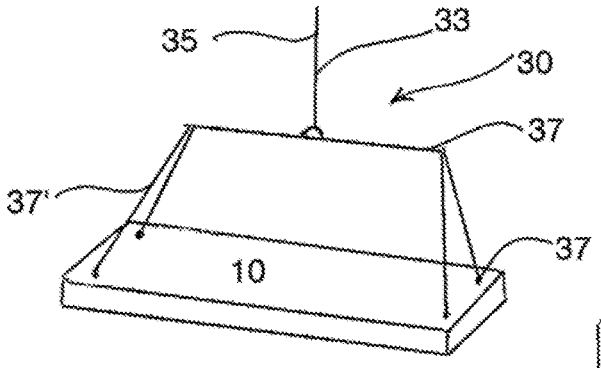
FIG. 10 illustrates a retrieval means for large-slab porous pavers.
Figure 6:
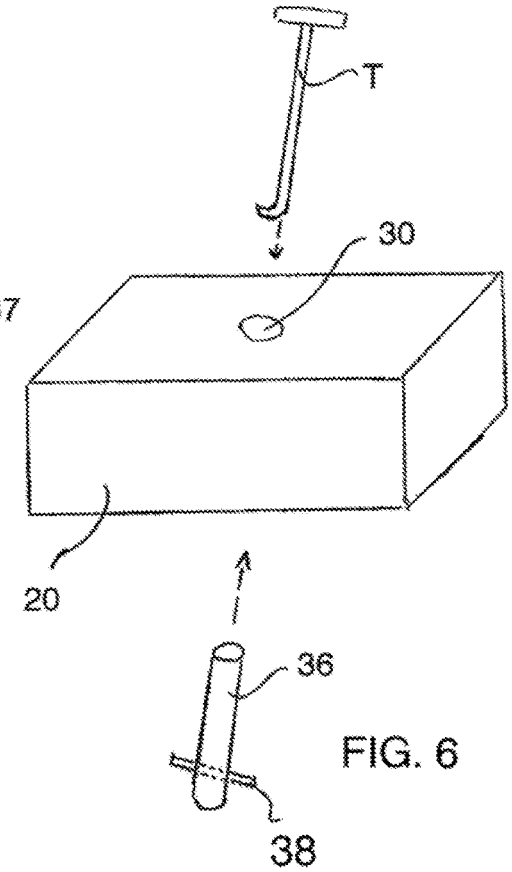
FIG. 6 is an exploded view, illustrating the assembly of the retrieval insert and the use of a tool to remove the porous cartridge from the hybrid paver according to the invention.
Figure 9:
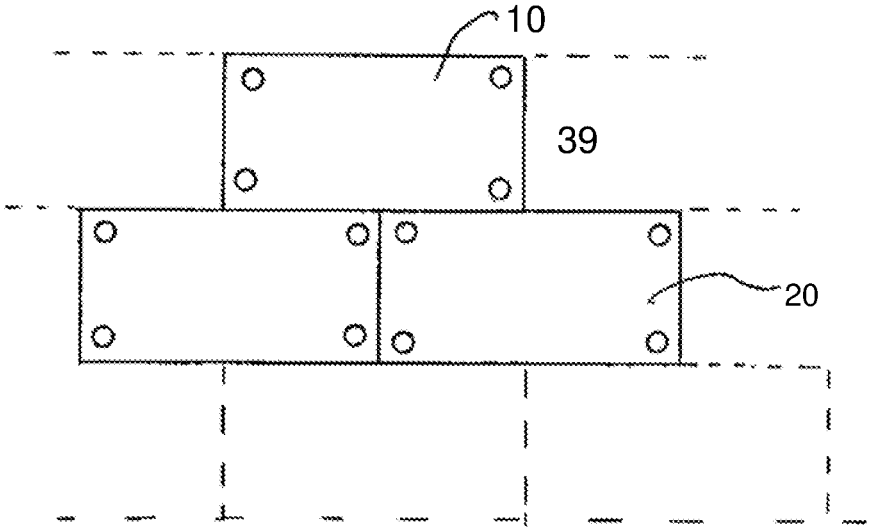
FIG. 9 illustrates a porous paved surface.

FIG. 9 illustrates a porous pavement surface that is not necessarily a hybrid surface, as described above, but instead, may be made up primarily of porous pavers 20. The embodiment shown uses large-slab porous pavers 20. Such large-slab pavers are heavy and difficult to handle. Being porous, it is also possible or desirable, that such porous pavers 20 be cleaned or replaced. Depending on the size of the paver, one paver may be too heavy to handle manually. FIG. 10 illustrates a further embodiment of the retrieval means 30, one that is well suited for manipulating, i.e., retrieving, lifting or lowering large, heavy pavers 20. Reference is made in the following description to porous pavers 20, but it is understood, that is possible to provide non-porous pavers 10 with the same retrieval means 30, and any description of the retrieval means 30 with reference to porous pavers 20 shall also apply to non-porous pavers 10. One or more lifting receptacles or lifting lugs 31 are embedded into the paver 20. The number and the location of the lugs 31 depends on the size and shape of the pavers 20. Four lifting lugs may be provided in a large rectangular paver; three or two or only one lug may be provided in smaller pavers. The lifting lugs 31 are constructed so as to be able to support the weight of the paver and withstand downward forces and are devices that are ideally countersunk into the pavers. The area around the countersink is capped with some suitable closure means 39, so as to provide a closed upper surface on the paver. There are many possible and acceptable constructions for the lifting lugs 31. For example, the receptacle 31 may be a threaded insert that is embedded in the paver, or may be a keyed opening that will receive and constrain some tool or device that is inserted into the opening. A lifting mechanism 33 for lifting the pavers is couplable with the one or more lifting receptacles or lugs 31. One embodiment of the lifting mechanism 33 is shown only schematically in FIG. 9. It is understood that various types and configurations of lifting devices may be used. One such suitable lifting mechanism is a hook suspended from a cable that is couplable with an attachment means 37 and that is operated by means of some conventional equipment that is typically used to lift heavy items in the construction industry, such as a tractor, or front-end loader, or a vehicle with a hoisting capability. The attachment means 37 may be specially constructed for a particular type of paver with a particular configuration of lifting lugs, such as the spider-like device shown in FIG. 9. The spider 37 has at least the number of legs 37' that corresponds to the number of lugs 31. Each leg 37' is attached to a corresponding one of the lifting lugs 31. Alternatively, the attachment means 37 may be a set of cables, each cable connectible at one end to a lifting lug and at the other end to the lifting mechanism.

It is understood that the embodiments described herein are merely illustrative of the present invention. Variations in the construction of the hybrid paver and/or the porous paved surface may be contemplated by one skilled in the art without limiting the intended scope of the invention herein disclosed and as defined by the following claims.

What is claimed is:

1. A porous slab comprising:

a porous slab consisting solely of a porous concrete made with course aggregate, so as to allow water to pass through the porous slab; and one or more retrieval means disposed within the porous slab.

2. The porous slab of claim 1 wherein the retrieval means is adapted to receive a tool that is used for removing and inserting the porous slab.

3. The porous slab of claim 2 wherein the retrieval means is a bar assembled in a sheath.

4. The porous slab of claim 2 wherein the retrieval means comprises a plurality of lifting lugs.

5. The porous slab of claim 4 wherein the lifting lugs are threaded inserts embedded within the porous slab.

6. The porous slab of claim 4 further comprising an attachment spider.

7. The porous slab of claim 6 wherein the attachment spider comprises a plurality of legs, and wherein at least one of the legs is connected at one end to one of the lifting lugs.

8. The porous slab of claim 7 wherein a plurality of the legs are connected at one end to a corresponding number of lifting lugs.

9. The porous slab of claim 8 wherein the retrieval means comprises four lifting lugs and wherein the attachment spider comprises four legs.

* * * * *